United States Patent [19]

Ciomek

[11] Patent Number: 5,064,463

[45] Date of Patent: Nov. 12, 1991

[54] FEEDSTOCK AND PROCESS FOR METAL INJECTION MOLDING

[76] Inventor: Michael A. Ciomek, 91 Pecksland Rd., Greenwich, Conn. 06830

[21] Appl. No.: 640,888

[22] Filed: Jan. 14, 1991

[51] Int. Cl.[5] ..... B32B 5/22

[52] U.S. Cl. ..... 75/314; 75/315; 75/255; 428/570

[58] Field of Search ..... 75/303, 314, 315, 329, 75/255; 428/570

[56] References Cited

U.S. PATENT DOCUMENTS 4,578,115 3/1986 Harrington et al. ..... 428/570

4,765,950 8/1988 Johnson ..... 419/2

4,801,328 1/1989 Canfield ..... 75/315

4,818,567 4/1989 Kemp et al. ..... 428/570

*Primary Examiner*—R. Dean

*Assistant Examiner*—George Wyszomierski

*Attorney, Agent, or Firm*—Hopgood, Calimafde, Kalil, Blaustein & Judlowe

[57] ABSTRACT

A feedstock for metal injection molding comprises a reactive metal powder selected from the group consisting of aluminum, magnesium and titanium coated with a less reactive metal selected from the group consisting of cobalt, copper, iron, nickel, tin and zinc dispersed in a binder.

16 Claims, No Drawings

FEEDSTOCK AND PROCESS FOR METAL INJECTION MOLDING

FIELD OF THE INVENTION

The present invention relates to feedstock for metal injection molding and more particularly to a feedstock for metal injection molding of aluminum, titanium and magnesium.

BACKGROUND OF THE INVENTION

Competitive considerations have caused metal part producers to develop processes for producing near net shape parts. These processes increase competitiveness by reducing scrap of high cost materials, lowering labor costs and minimizing subsequent processing or machining operations. These processes are also capable of producing large lots of intricate parts thereby further improving the overall economics.

Processes for producing near net shape parts include investment casting, powder metallurgy, semi-solid forming and metal injection molding. Most of these processes can process a wide range of metals including both ferrous and nonferrous metals. However, the range of metals that can be treated by metal injection molding has heretofore been predominantly limited to the processing of less reactive metal powders.

Powders of reactive metals, such as aluminum, magnesium and titanium, rapidly form surface oxide films which interfere with the production of parts having adequate green strength after molding, debinding or, in some instances, lower densities even after sintering. Unlike melting or semi-melting processes, which disperse or rupture the oxide film or powder metallurgy pressing operations, which employ sufficient pressures to provide good green strength, metal injection molding does not employ conditions which can readily mitigate the adverse effects of the oxide films present on the surfaces of most metal powders, particularly more reactive metal powders. Moreover, the oxide films on reactive metal powders are not readily reduced during debinding and/or sintering. For these reasons, metal injection molding has not been widely regarded as being useful for processing reactive metal powders.

Coated metal powders are well known in the art and have been used in conventional powder metallurgical processing. For example, electroless copper-coated aluminum has been powder metallurgically formed at pressures of four tons per square centimeter. See Japanese Patent Application No. 45,707, dated Aug. 28, 1973. Aluminum is electrolessly plated with copper employing an aqueous solution of copper sulfate, potassium sodium tartrate, sodium hydroxide and formaldehyde.

Aluminum powder has also been electrolessly plated with nickel by immersion in an aqueous solution of nickel chloride or sulfate, boric acid, sodium chloride and hydrofluoric acid. See USSR Patent No. 361,224, dated Nov. 16, 1970.

Another process for electroless coating aluminum powder with nickel is disclosed in an article by R. Narayw et al. in the *International Journal of Powder Metallurgy and Powder Technology*, Volume 19, April 1983, pages 101 to 105. After pretreatment to remove its oxide coating, aluminum powder is immersed in an aqueous bath of nickel chloride, sodium hypophosphite, sodium citrate and ammonium chloride.

The prior art also discloses other processes for coating metal powders including aluminum, titanium and magnesium.

Numerous U.S. patents disclose processes and binder systems for metal injection molding and some detail the problems associated with processing reactive metal powders. U.S. Pat. No. 4,964,907 to Kryata et al. discloses a process for metal injection molding titanium powder and examples of binder systems useful for metal injection molding. U.S. Pat. No. 4,765,950 to Johnson discloses and claims a novel binder system for metal injection molding which comprises two organic components one of which has a higher melting point that the other. The disclosures of U.S. Pat. Nos. 4,964,907 and 4,765,950 are incorporated herein by reference.

OBJECTS OF THE INVENTION

An object of the present invention is to provide a feedstock of at least one reactive metal selected from the group consisting of aluminum, magnesium and titanium suitable for metal injection molding.

Another object of the invention is to provide a metal injection molding feedstock of a reactive metal powder which provides goods green strength after metal injection molding.

A further object is to provide a metal injection molding feedstock of a reactive metal powder which has good flow properties during metal injection molding.

An even further object is to provide a metal injection molding feedstock of a reactive metal powder which can be produced economically.

Still another object of the present invention is to provide a metal injection molding feedstock of a reactive metal powder which can be used with existing equipment.

SUMMARY OF THE INVENTION

Broadly stated, the present invention relates to a metal injection molding feedstock of at least one reactive metal selected from the group consisting of aluminum, magnesium and titanium. The feedstock comprises a powder of the reactive metal dispersed in a binder which powder has a coating of a less reactive metal selected from the group consisting of cobalt, copper, iron, nickel, tin and zinc.

DETAILED DESCRIPTION OF THE INVENTION

As noted hereinbefore, the present invention relates to a metal injection molding feedstock of a reactive metal selected from the group consisting of aluminum, magnesium and titanium. As used herein, the term "reactive metal powder" includes elemental metal powders and alloys of these metals with each other or with other alloying metals.

The reactive metal powders should ordinarily have an average particle size less than about 45 microns, preferably less than about 20 microns and even more preferably 10 microns or less. Metal powders for traditional powder metallurgical processes can employ larger average particle sizes because the pressing pressures are sufficiently great to insure die filling and high green densities and because somewhat more coarse particles have better flow properties. However, metal injection molding processes, which typically use molding pressures less than about 10,000 pounds per square inch (psi), require far smaller average particle sizes to provide higher green densities, better flow properties of the feedstock, more uniform densities of the molded parts and more uniform sintering which provides greater dimensional control.

In addition to powdered metals, metal injection molding feedstocks also contain a binder and may also contain plasticizers, lubricants and debinding promoters. As far as the present invention is concerned, any binder composition can be employed as long as the binder composition does not destroy or interfere with the coatings or the reactive metal powders as described hereinafter. Thus, aqueous or organic based binders can be used in accordance with the present invention, although it is preferred to use organic-based binders since water may react with the coated reactive metal powders if the coating is porous and/or if the feedstock is stored long periods before use.

Binders generally useful in the present invention contain a thermoplastic resin and/or a wax. Nonlimiting examples of thermoplastic resin include acrylic polyethylene, polypropylene and polystyrene. Nonrestrictive examples of waxes include bees, Japan, montan and synthetic waxes. Binders may also contain, if necessary, plasticizers, such as dioctyl phthalate, diethyl phthalate, di-n-batyl phthalate and diheptyl phthalate.

A particularly advantageous binder system is disclosed in U.S. Pat. No. 4,765,950, which binder comprises a higher melting point thermoplastic resin combined with a lower melting point component, such as vegetable oil, hydrogenated vegetable oil, waxes or combinations thereof. The combination of low and higher melting point components in the binder help minimize cracking of the molded part during cooling. After the molded part is cooled to ambient temperature the lower melting point component is selectively dissolved leaving a porous structure from which the higher melting point component can be efficiently removed by thermal debinding.

Feedstock in accordance with the present invention can be prepared by blending the coated metal powders with the binder, and the blend is heated to form a slurry. Uniform dispersion of the metal powder in the slurry is achieved by employing high shear mixing. The slurry of metal powders in the binder is cooled to ambient temperature and then granulated to provide feedstock for metal injection molding. The amount of binder and metal powder are selected to optimize moldability while insuring acceptable green densities. In most instances the feedstock will contain a binder in an amount of up to about 60%, by volume, i.e. 30% to 50%, by volume.

An important aspect of the present invention is the use of a reactive metal powder having a coating of a less reactive metal selected from the group consisting of cobalt, copper, iron, nickel, tin and zinc. The less reactive metal coating is selected to be compatible with the reactive metal powder. For example, it is preferred to coat aluminum powder with copper because aluminum-based alloys containing copper and their resulting properties are well established. Likewise, titanium powder can be coated with tin as tin is a well recognized alloying ingredient in titanium alloys. Magnesium powder can be coated with zinc. The foregoing examples are not meant to be limiting but only to serve as an aid in selecting a metal coating for a specific reactive metal powder.

The less reactive metal coating on the reactive metal powder is advantageously metal-to-metal, i.e. the less reactive metal is deposited on the metal surface of the reactive metal powder and not on an oxide film or layer. If the less reactive metal is deposited on an oxide film or surface layer, the beneficial results of improved green strength and improved sintering and homogenization may not be realized. The less reactive metal coating does not have to coat the entire surface of all the reactive metal particles but only a portion sufficient to achieve the beneficial results detailed herein.

In order to achieve a metal-to-metal coating of the less reactive metal as the reactive metal powder the reactive metal powder should be processed to insure the simultaneous removal of its oxide film and the deposition of the less reactive metal. Processes which may deposit the less reactive metal on the oxide coating of the reactive metal powder may not produce coated metal powders that are useful as a feedstock in accordance with the present invention. For example, coating a reactive metal powder with nickel by nickel carbonyl decomposition will not simultaneously remove the oxide film associated with the reactive metal powder. Likewise, electrochemical deposition may not be effective in removing the oxide coating before the less reactive metal is eletrodeposited on the reactive metal powder. Electroless plating may likewise be non-effective if the oxide coating on the reactive metal powder is not simultaneously removed. Although the present invention is not limited by the process by which the coated active metal is produced, it is advantageous for effectiveness and cost considerations to use chemical replacement reactions in which the oxide film on the reactive metal is removed while the less reactive metal is simultaneously deposited on the freshly exposed metallic surface of the reactive metal powder. An advantage of using chemical replacement type reactions, also known as cementation, is that frequently such deposits are somewhat porous or spongy which can enhance the green strength of the molded part.

Aluminum powder, for example, can be coated with copper by a cementation type reaction. An aqueous solution of cupric sulfate or cupric chloride is prepared and aluminum powder is added thereto. Depending upon the temperature, concentration of the cupric salt and time the oxide film on the aluminum powder begins to dissolve and copper is immediately deposited on the exposed metallic aluminum surface. If the reaction is too slow, an inorganic acid can be added to the cupric salt solution to lower the pH sufficiently to promote dissolution of the aluminum oxide film. Alternatively, a base, such as sodium hydroxide, can be added to the solution to prevent oxide removal. At times the reaction may proceed too rapidly and it may be advantageous to use a cupric salt solution which has a pH above about 7 to provide a process that is more readily controlled. For example, ammonium, sodium hydroxide, or organic amines can be added to the cupric salt solution prior to the addition of the aluminum powder.

Nonlimiting examples of amines that can be used include ethylene diamine diethylene diamine and diethyl amine. Whether treating the aluminum in an acidic or basic solution the solution should be neither too acidic or too basic as the reaction may become uncontrollable. Advantageously, the cupric salt solution should have a pH value between about 2 and 11. After sufficient copper has been deposited on the aluminum powder, the coated powder can be separated from the solution and washed.

Similar processes can be used for coating magnesium and titanium powders. Although it is preferred to coat the reactive metal powder in aqueous solutions, nonaqueous solutions can be employed if the solvent and dissolved less reactive metal compound are capable of simultaneously removing the oxide film in the reactive metal powder while depositing the less reactive metal on the exposed reactive metal surfaces.

In use, the feedstock is fed to the feed barrel of an injection molding machine where the feedstock is remelted. The remelted feedstock is then injected into a cool mold under moderate pressure (i.e. less than 10,000 psi) to form a green compact, which sets in the cool mold as the thermoplastic resin solidifies. The green compact is ejected from the mold and subjected to debinding, which debinding step or steps are determined by the nature of the binder system. After debinding the green compact is heated to a temperature sufficiently high to insure sintering, densification and homogenization by diffusion.

EXAMPLE

A aqueous solution of cupric chloride and ammonium having a pH about 9 is prepared. Aluminum powder is added to the cupric chloride solution and stirred. Stirring is continued until the aluminum powder is visually observed to have a copper coating. The cupric chloride solution is decanted, and the copper coated aluminum powder is washed with water before drying.

The copper-coated aluminum is blended with polypropylene resin and peanut oil in the following amounts:

| Component | % Wt |
|---|---|
| Cu-coated aluminum powder | 77.6 |
| Polypropylene resin | 5.6 |
| Peanut oil | 16.8 |

The blended mixture is heated to 350° F. in a high shear mixture to produce a uniform dispersion of the coated aluminum powder in the binder. The heated dispersion is cooled and then granulated to produce feedstock.

The feedstock is formed at moderate pressures and at a temperature sufficiently high to insure good moldability. The green form is cooled to room temperature and is then selectively loaded with methylene chloride to dissolve the peanut oil. The partially debound form is then gradually heated to 1100° F. to first remove the residual binder and then to sinter and homogenize the copper-coated aluminum powder.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. In a feedstock for metal injection molding consisting essentially of a metal powder suspended in a binder, the improvement which comprises the metal powder being at least one reactive metal selected from the group consisting of aluminum, magnesium and titanium coated with at least one less reactive metal selected from the group consisting of cobalt, copper, iron, nickel, tin and zinc.

2. The improvement as described in claim 1 wherein the reactive metal is coated metal-to-metal with the less reactive metal.

3. The improvement as described in claim 2 wherein the reactive metal is aluminum.

4. The improvement as described in claim 3 wherein the less reactive metal is copper.

5. The improvement as described in claim 2 wherein the reactive metal is magnesium and the less reactive metal is zinc.

6. The improvement as described in claim 2 wherein the reactive metal is titanium and the less reactive metal is tin.

7. The improvement as described in claim 2 wherein the reactive metal comprises an alloy based on said reactive metal.

8. The improvement as described in claim 2 wherein the reactive metal powder has an average particle size of less than about 45 microns.

9. The improvement as described in claim 8 wherein the average particle size is less than about 20 microns.

10. The improvement as described in claim 9 wherein the average particle size is less than about 10 microns.

11. The improvement as described in claim 2 wherein the binder constitutes between about 30% and 50%, by volume, of the feedstock.

12. The improvement as described in claim 2 wherein the less reactive metal has been deposited on freshly exposed surfaces of the reactive metal powder by chemical replacement from a solution containing a dissolved salt of the less reactive metal.

13. In a feedstock for metal injection molding consisting essentially of a metal powder dispersed in a binder the improvement which comprises the metal powder being aluminum coated with copper.

14. The improvement as described in claim 13 wherein the copper-coated aluminum powder has an average particle size of less than about 45 microns.

15. The improvement as described in claim 14 wherein the powder has an average particle size of less than about 20 microns.

16. The improvement as described in claim 15 wherein the powder has an average particle size of less than about 10 microns.

* * * * *